US009768514B2

(12) United States Patent
Tchoffo Talom et al.

(10) Patent No.: US 9,768,514 B2
(45) Date of Patent: Sep. 19, 2017

(54) HORN, ELEMENTARY ANTENNA, ANTENNA STRUCTURE AND TELECOMMUNICATION METHOD ASSOCIATED THEREWITH

(71) Applicant: THALES, Neuilly sur Seine (FR)

(72) Inventors: Friedman Tchoffo Talom, Herblay (FR); Gilles Quagliaro, Cormeilles en Parisis (FR)

(73) Assignee: THALES, Neuilly sur Seine (FR)

( * ) Notice: Subject to any disclaimer, the term of this patent is extended or adjusted under 35 U.S.C. 154(b) by 220 days.

(21) Appl. No.: 14/554,700

(22) Filed: Nov. 26, 2014

(65) Prior Publication Data

US 2015/0145739 A1 May 28, 2015

(30) Foreign Application Priority Data

Nov. 28, 2013 (FR) ..... 13 02761

(51) Int. Cl.

| | |
|---|---|
| ***H01Q 19/06*** | (2006.01) |
| ***H01Q 13/02*** | (2006.01) |
| ***H01Q 15/24*** | (2006.01) |
| ***H01Q 1/28*** | (2006.01) |
| ***H01Q 21/06*** | (2006.01) |
| ***H01Q 5/42*** | (2015.01) |
| ***H01Q 5/55*** | (2015.01) |

(52) U.S. Cl.

CPC ..... *H01Q 13/02* (2013.01); *H01Q 1/288* (2013.01); *H01Q 5/42* (2015.01); *H01Q 5/55* (2015.01); *H01Q 13/0241* (2013.01); *H01Q 15/244* (2013.01); *H01Q 21/064* (2013.01)

(58) Field of Classification Search

CPC .. H01C 19/195; H01C 15/244; H01C 25/001; H01C 15/22; H01C 15/24

USPC ..... 343/754, 756

See application file for complete search history.

(56) References Cited

U.S. PATENT DOCUMENTS

| | | | | |
|---|---|---|---|---|
| 4,792,814 A * | 12/1988 | Ebisui | H01Q 13/025 | 343/772 |
| 5,563,616 A * | 10/1996 | Dempsey | H01Q 1/38 | 343/700 MS |
| 5,600,740 A * | 2/1997 | Asfar | G02B 6/124 | 333/208 |
| 6,201,508 B1 * | 3/2001 | Metzen | H01Q 13/0258 | 343/776 |
| 6,292,153 B1 * | 9/2001 | Aiello | H01Q 1/36 | 343/767 |

(Continued)

FOREIGN PATENT DOCUMENTS

WO WO 2007/071475 6/2007

*Primary Examiner* — Huedung Mancuso

(74) *Attorney, Agent, or Firm* — Davidson, Davidson & Kappel, LLC

(57) ABSTRACT

A horn (12) for elementary antennas for telecommunications, in particular satellite telecommunications, characterized in that the horn (12) includes a first emitting-receiving portion (22) adapted to emit and receiving an electromagnetic wave at a first frequency and a second emitting-receiving portion (24) adapted to emit and receiving an electromagnetic wave at a second frequency, the second emitting-receiving portion (24) being distinct and separate from the first emitting-receiving portion (22) and the ratio between the second frequency and the first frequency being greater than 1.2, preferably greater than 1.5.

14 Claims, 3 Drawing Sheets

(56) References Cited

U.S. PATENT DOCUMENTS

| | | | | |
|---|---|---|---|---|
| 6,323,819 | B1 * | 11/2001 | Ergene | H01P 1/161 333/134 |
| 6,834,546 | B2 * | 12/2004 | Edvardsson | G01F 23/284 340/612 |
| 7,280,011 | B2 * | 10/2007 | Bayar | H01P 1/207 333/208 |
| 8,514,140 | B1 * | 8/2013 | Rao | H01Q 13/025 343/772 |
| 8,897,695 | B2 * | 11/2014 | Becker | A62C 35/60 333/125 |
| 2011/0133981 | A1 * | 6/2011 | Magnon | A61B 5/06 342/146 |
| 2011/0267250 | A1 * | 11/2011 | Seifried | H01Q 21/064 343/776 |
| 2012/0169557 | A1 | 7/2012 | Naym et al. | |
| 2013/0100822 | A1 * | 4/2013 | Caillerie | H04B 7/04 370/241 |
| 2014/0104107 | A1 * | 4/2014 | Mangenot | H01Q 3/26 342/371 |
| 2014/0266934 | A1 * | 9/2014 | Cook | H01Q 1/44 343/720 |

* cited by examiner

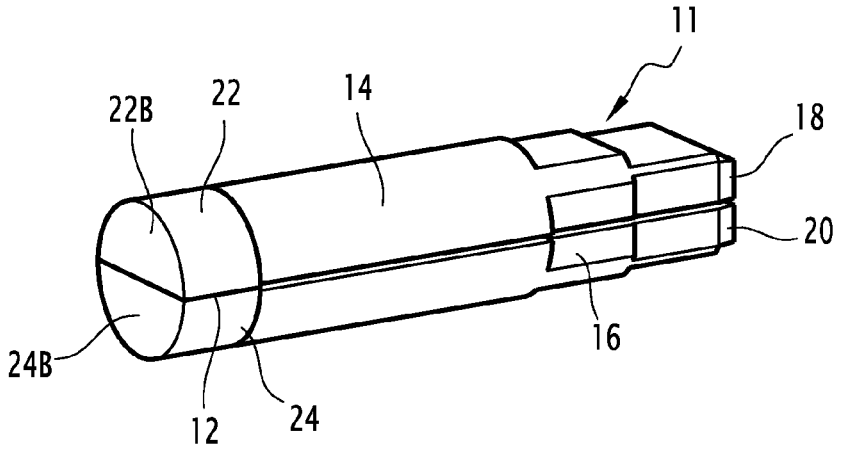
FIG.3
FIG.4
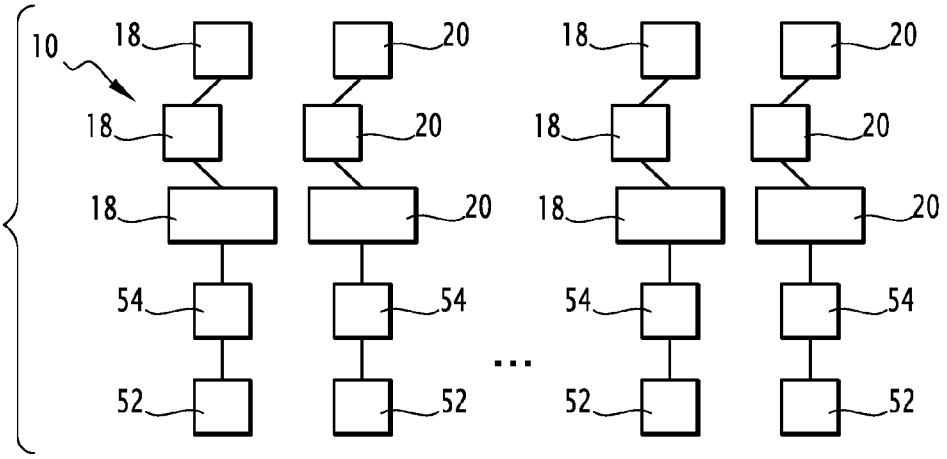
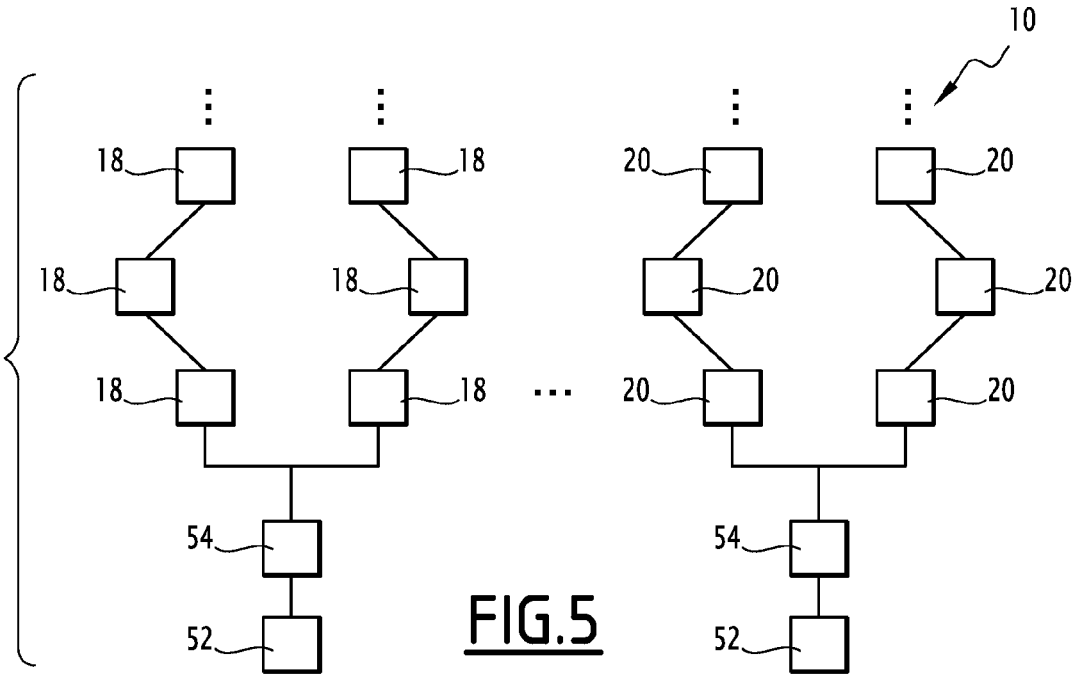
FIG.5

HORN, ELEMENTARY ANTENNA, ANTENNA STRUCTURE AND TELECOMMUNICATION METHOD ASSOCIATED THEREWITH

This claims the benefit of French Patent Application FR 13 027 61, filed Nov. 28, 2013 and hereby incorporated by reference herein.

The present invention relates to a horn for an antenna structure for telecommunications, in particular by satellite in the Ka band. The invention also relates to an elementary antenna comprising such a horn, an antenna structure comprising such an elementary antenna and a method for telecommunication between two stations using the antenna structure.

BACKGROUND

In the field of satellite communications, obtaining a high quality of communication entails achieving performance enhancements for the electromagnetic waves generated by the antenna structure used in the communication in terms of gain and level of side lobes (ratio between the intensity of the side lobes and the intensity of the main lobe).

In the specific case of the Ka band of the electromagnetic spectrum, two distinct bands of frequencies are involved. Indeed, in emission, the electromagnetic waves of the Ka band have a frequency within the range of 27.5 GigaHertzs (GHz) to 31 GHz whereas in reception, the electromagnetic waves of the Ka band have a frequency within the range of 17.3 GHz to 21.2 GHz. In addition, the polarisations of the waves in emission and in reflection are generally of circular type, either opposing or not.

These frequencies and the circular polarisations in reception and emission impose constraints on the antenna structure. In addition, in the context of satellite linking, it is necessary to orient the antenna in order to point the satellite that is being used to establish the link. In addition, in order to reduce the visual signature (physical footprint), solutions of the parabolic antenna type are generally not preferred.

Among the antenna structures that provide the ability to compliantly accommodate these various constraints, a known technique is to use an electronic scanning phased array antenna comprising two disjoint antenna panels respectively for the emission of a wave at a frequency of 30 GHz, and for the reception of a wave at a frequency of 20 GHz. However, the electronic scanning phased array antenna obtained presents a significant dimensional footprint corresponding to the radiating surfaces for each of the modes of operation (emit/receive). Besides, such types of antenna offer a level of efficiency that is often inadequate because most often patch type unit antennas are used. In addition, the implementation of a circular polarisation in a right orientation for emission panel and a circular polarisation in a second direction opposite to previous one for the reception portion turn out to be difficult. In particular, the use of a polariser reduces the flexibility of use of the electronic scanning antenna considered.

In order to limit the losses of the electronic scanning phased array antenna, it is also a known practice to use horn type structures so as to obtain improved efficiency levels.

However, in this case also, the antenna obtained presents a significant overall dimensional footprint on account of the use of a polariser and especially two panels used for the emission and reception.

SUMMARY OF THE INVENTION

It is an object of the present invention to provide an antenna structure that is capable of receiving waves at a frequency that is distinct and separate from those of the emitted waves while also being compact.

The present invention provides a horn for elementary antennas for telecommunications, in particular satellite telecommunications. The horn includes a first emitting-receiving portion capable of emitting and receiving an electromagnetic wave at a first frequency, and a second emitting-receiving portion capable of emitting and receiving an electromagnetic wave at a second frequency, the second emitting-receiving portion being distinct and separate from the first emitting-receiving portion, and the ratio between the second frequency and the first frequency being greater than 1.2, preferably greater than 1.5.

According to the particular embodiments, the horn includes one or more of the following characteristic features, taken into consideration individually or in accordance with any technically possible combinations:

- the waves at the first frequency and at the second frequency are included in the Ka band of the electromagnetic spectrum;
- the horn has a cylindrical or cubic shaped form.

In addition, the invention also relates to an elementary antenna comprising at least one horn as previously described above.

According to the particular embodiments, the elementary antenna includes one or more of the following characteristic features, taken into consideration individually or in accordance with any technically possible combinations:

- the elementary antenna comprises dielectric elements;
- the elementary antenna comprises a polariser arranged in a manner so as to polarise the waves that the first emitting-receiving portion and the second emitting-receiving portion are capable of emitting;
- the polariser comprises of two parts arranged in a manner so as to circularly polarise in a first direction the electromagnetic waves that the first emitting-receiving portion is capable of emitting and to circularly polarise the electromagnetic waves that the second emitting-receiving portion is capable of emitting in a direction opposite to the first direction.

The invention also relates to an antenna structure comprising at least one elementary antenna as previously described above.

In addition, the invention also relates to a platform, in particular an aerial platform, comprising at least one elementary antenna such as previously described above or an antenna structure such as previously described above.

The present invention also relates to a method for telecommunication, in particular via satellite, between two stations, the method including the use of at least one elementary antenna such as previously described above or an antenna structure such as previously described above.

BRIEF DESCRIPTION OF THE DRAWINGS

Other characteristic features and advantages of the invention will become apparent upon reading the detailed description that follows, of embodiments of the invention, being provided purely by way of example only and with reference made to the drawings which include the following:

FIG. 4, is a block diagram of an antenna structure according to a second embodiment;

FIG. 5, is a block diagram of an antenna structure according to a third embodiment;

DETAILED DESCRIPTION

Figure 1:
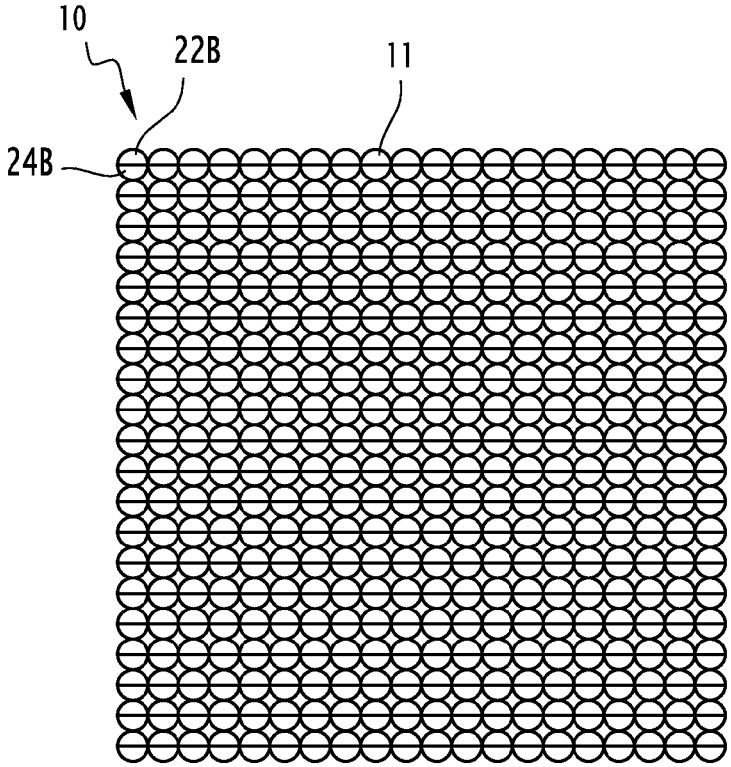
FIG. 1, is a schematic top view of an antenna structure according to a first embodiment.
Figure 2:
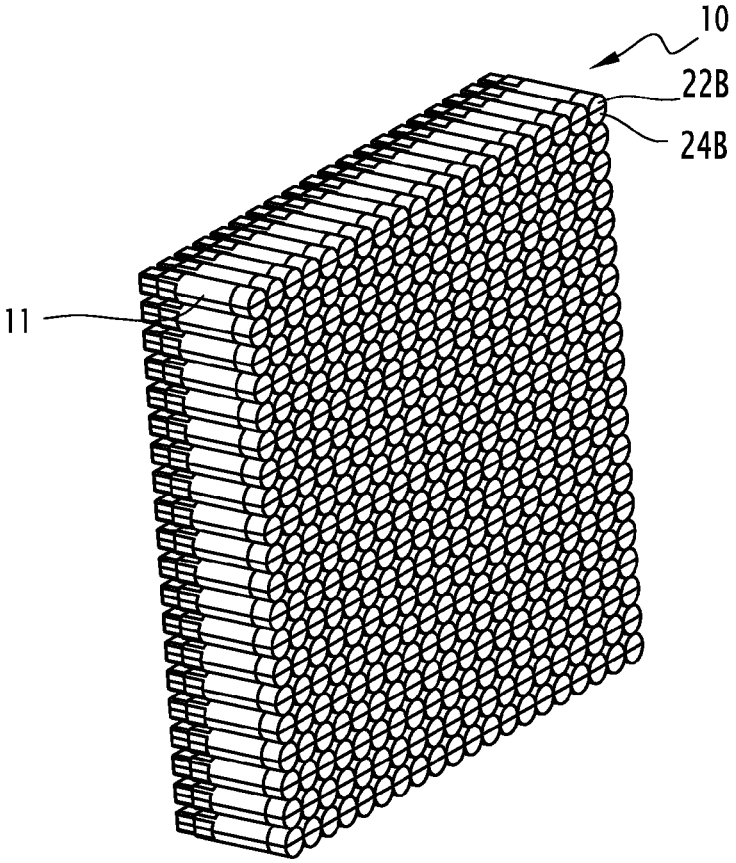
FIG. 2, is a schematic perspective view of the antenna structure represented in FIG. 1, FIG. 3, is a schematic perspective view of an elementary antenna of the antenna structure represented in FIG. 1.

An antenna structure 10 according to a first embodiment is represented in FIGS. 1 and 2.

The antenna structure 10 is an assembly of elementary antennas 11 assembled in a manner so as to obtain twenty rows grouping together twenty adjoining elementary antennas 11. This description would be valid for any number of rows and for any other arrangement of elementary antennas 11.

As illustrated in FIG. 3, each elementary antenna 11 includes a horn 12, a polariser 14, dielectric elements 16 and 18 two access ports 20 for the waves emitted or received by the elementary antenna 11.

The horn 12 comprises a first emitting-receiving portion 22 capable of emitting and receiving an electromagnetic wave at a first frequency f1 and a second emitting-receiving portion 24 capable of emitting and receiving a wave at a second frequency f2.

The second emitting-receiving portion 24 is distinct and separate from the first emitting-receiving portion 22. The emitting-receiving portions 22 and 24 may in one embodiment be combined into one single block.

The ratio between the second frequency f2 and the first frequency f1 is greater than 1.2.

Preferably, the ratio between the second frequency f2 and the first frequency f1 is greater than 1.5.

Advantageously, the waves whereof the frequency is the first frequency f1 or the second frequency f2 are included in the Ka band of the electromagnetic spectrum.

By way of a variant, the waves whereof the frequency is the first frequency f1 or the second frequency f2 are included in the X band of the electromagnetic spectrum.

By definition, an electromagnetic wave belongs in the X band when the wave has a frequency within the range of 7.2 GHz to 8.4 GHz.

According to another variant embodiment, the waves whereof the frequency is the first frequency f1 or the second frequency f2 are included in the Ku band of the electromagnetic spectrum.

By definition, an electromagnetic wave belongs in the Ku band when the wave has a frequency within the range of 10.7 GHz to 14.25 GHz.

The horn 12 has a cylindrical or cubic shaped form. Owing to this form the emission of the elementary antenna 11 takes on a broad band character. The band covered by a horn typically extends to 40% on either side of the operating frequency.

The horn 12 has a cylindrical shaped form which corresponds to the joining of the first emitting-receiving portion 22 and the second emitting-receiving portion 24. The basis of each emitting-receiving portion 22, 24 is respectively called 22B and 24B.

Thus, in this embodiment, the first basis 22B of the first emitting-receiving portion 22 and the basis 22B of the second emitting-receiving portion 24 each has the shape of a half-disk, the joining of the two emitting-receiving portions thus forming the horn 12.

Figure 6:
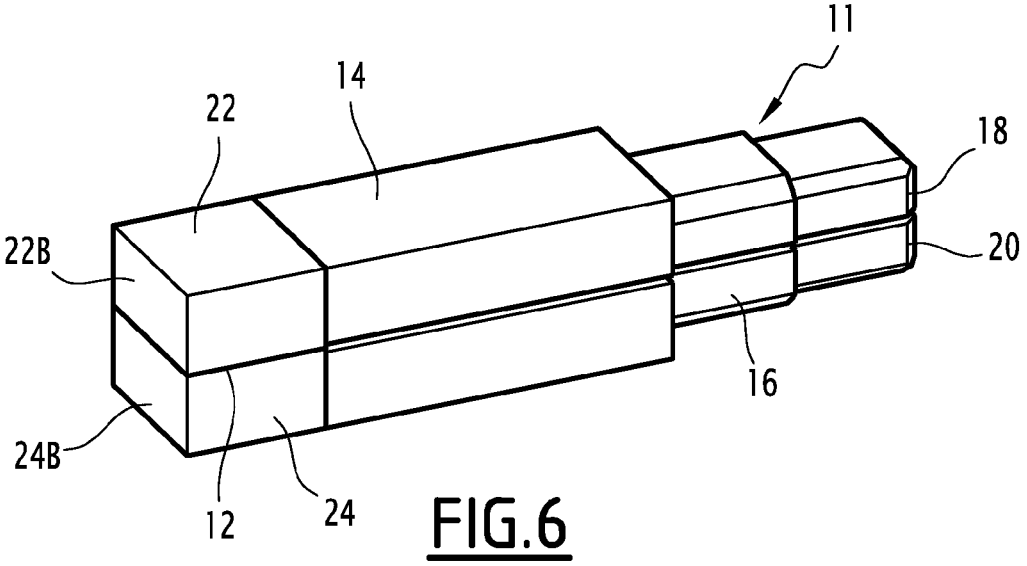
FIG. 6, is a schematic perspective view of another example of elementary antenna.

According to another embodiment illustrated by FIG. 6, the first basis 22B of the first emitting-receiving portion 22 and the basis 22B of the second emitting-receiving portion 24 each has the same rectangular shape, the joining of the two emitting-receiving portions thus forming the horn 12.

More generally, the first emitting-receiving portion 22 and the second emitting-receiving portion 24 each are each cylinder such that the joining of the two emitting-receiving portions forms the horn 12.

According to a specific embodiment, the basis 22A of first basis 22B of the first emitting-receiving portion 22 and the basis 22B of the second emitting-receiving portion 24 have the same shape. As shown on FIG. 6, the first emitting-receiving portion 22 and the second emitting-receiving portion 24 have a basis 22B, 24B sharing the same rectangular shape, so that the joining of the two basis 22B, 24B forms a square.

Figure 7:
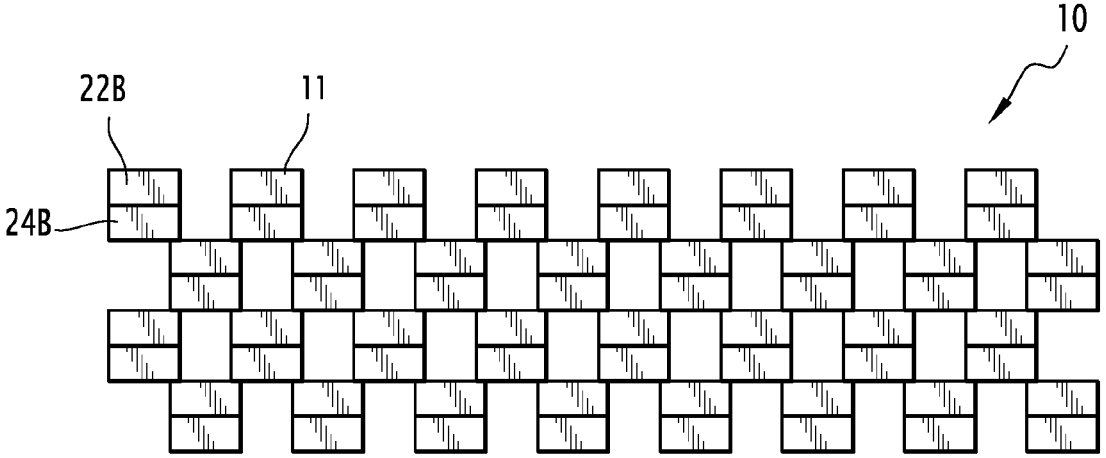
FIG. 7, is a schematic top view of an antenna structure comprising elementary antennas according to FIG. 6, and FIG. 8, is a schematic view of a power splitter circuitry adapted to feed a row of elementary antennas in the antenna structure of FIG. 7.

In such case, as illustrated schematically by FIG. 7, the antenna structure 10 is an assembly of elementary antennas 11 assembled in a manner so as to obtain four rows grouping together eight adjoining elementary antennas 11.

This description would be valid for any number of rows and for any other arrangement of elementary antennas 11. Preferably, there are twice the number of rows of elementary antennas 11 in each row.

In addition, the rows are staggered rows, which means that the elementary antennas 11 of the first row are aligned with the elementary antennas 11 of the third row whereas the elementary antennas 11 of the second row are aligned with the elementary antennas 11 of the fourth row.

Figure 8:
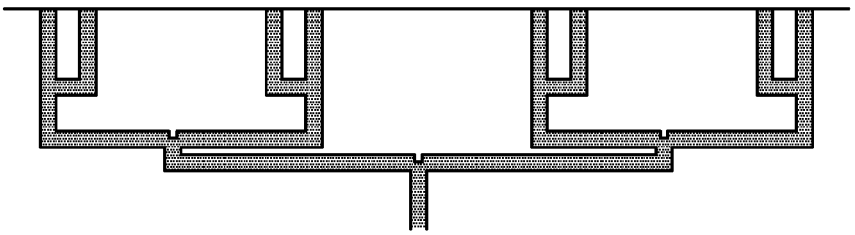

FIG. 8 illustrates an example of the circuitry adapted to command a row of the antenna structure 10. It can notably be noticed that there are four excitation access for the four involved states of polarisation, which are the polarisation Tx, the polarisation Rx and the polarisation LHCP (for Left Hand Circular Polarisation) and the polarisation RHCP (for Right Hand Circular Polarisation).

In a conventional manner, a horn that is suitably dimensioned in order to operate over a broad frequency band has exterior dimensions which are constrained by the wavelength of operation corresponding to the lowest of the frequencies to be emitted or received. In addition, the interior of the latter is empty.

In the example shown, identical to the dielectric elements 16, the interior of the horn 12 is filled with a dielectric material in order to reduce the physical dimensions of the horn 12. In effect, the wavelength in a dielectric material is smaller than the corresponding wavelength in air. Thus, for a given horn structure, a widening up to the frequency of operation is achieved. This dielectric material is a substrate having a permittivity in the range from 2 to 5 depending on design and fabrication constraints.

The polariser 14 is arranged in a manner so as to polarise the waves that the first emitting-receiving portion 22 and the second emitting-reception portion 24 are capable of emitting.

The polariser 14 comprises of two parts arranged in a manner so as to circularly polarise in a first direction the waves that the first-emitting-receiving portion 22 is capable of emitting and to circularly polarise the waves that the second emitting-receiving portion is capable of emitting 24 in a direction opposite to the first direction.

For the remainder of the description, the first direction is the right polarisation.

Thus, the elementary antenna 11 is capable of emitting and/or receiving waves having a right circular polarisation at the first frequency f1. The elementary antenna 11 is also capable of emitting and/or receiving waves having a left circular polarisation at the second frequency f2.

According to one variant embodiment, the polariser 14 is part of the horn 12.

In the elementary antenna 11, the dielectric elements 16 are inserted so as to reduce the electrical dimension in relation to the wavelength and thus to have a basic antenna with dimensions that make it possible to get sufficiently close to the radiating elements at the time of establishing networking in order to facilitate angular scanning over a range that is sufficiently wide while ensuring maintenance of the compatible radiation performance of the satellite link type application considered. The dielectric elements 16 are preferably only located at the access ports 18, 20 as well as in the polariser 14. By way of a variant, the dielectric elements 16 are extended in the parts 22 and 24.

Each access port 18, 20 is arranged to be opposite a emitting-receiving portion of the horn 12. In the example shown in FIG. 1, an access port 18 for a left circularly polarised wave is provided opposite the first emitting-receiving portion 22 of the horn 12 while an access port 20 for the right circularly polarised wave is provided opposite the second emitting-receiving portion 24.

According to a variant embodiment, the antenna structure 10 includes a radome.

In operation, the first emitting-receiving portion 22 receives the electromagnetic waves at a first frequency f1 when the horn 12 is electrically excited. This wave is left circularly polarised by the polariser 14. This wave then passes through the access port 18 provided for a left circularly polarised wave.

A right circularly polarised wave at the second frequency f2 passes through the access port 20 provided for a right circularly polarised wave. This wave then passes through the polariser 14 before being emitted by the second emitting-receiving portion 24. This emitting-receiving operation can be reversed between the access ports 18 and 20.

It thus appears that a single element provides the ability to ensure both the emission and reception functions, for two frequencies where the ratio there between is greater than 1.2. This is a compact dual band horn 12 with circular polarisation which thereby makes the elementary antenna 11 dual band.

In addition, each elementary antenna 11 is capable of emitting and/or receiving waves in two different states of polarisation, in the present case for example as shown in FIG. 1, the left and right circular polarisations. In the case where a wave with linear polarisation is desired, the two access ports 18, 20 are used simultaneously by applying a certain phase shift depending on the orientation of the polarisation desired.

In addition, it is easy to dissociate the portion dedicated to the radiation in the antenna structure 10 from other elements of the antenna structure 10 and in particular, the portion dedicated to the switching, the filtering and to the distribution circuit. This dissociation makes it possible to minimise the overall losses of the antenna structure 10.

The antenna structure 10 is more compact. This effect is enhanced by the presence of the dielectric elements 16. The antenna structure 10 may have dimensions measuring less than 30 mm.

In this first embodiment, each of the access ports 18 and 20 of the different elementary antennas 11 are connected to a duplexer not shown with a view to ensuring adequate isolation between the first and second emitting-receiving portions 22, 24. A duplexer is a device that enables the use of a same given antenna for the emitting and receiving of a signal. The switches and power splitter inserted between the duplexer and the access ports 18, 20 can make possible to correctly feed each elementary antenna and to easily select of the access port 18, 20 and the operation desired for the antenna structure 10.

In addition, each elementary antenna 11 is associated with a phase control circuit. Thus, it is possible to orient the beam of the antenna structure 10 in any desired directions in a hemisphere, based on the phase control circuits associated with each of the elements 11. As per the terminology used by the specialist in the field of antennas, this is known as implementing a two dimensional scanning or bidirectional scanning.

By way of a variant, the antenna structure 10 operates based on three distinct modes: a fixed mode, a unidirectional scanning mode and a bidirectional scanning mode. Switching between the three modes is executed by making use of a circuit for distribution and control of the appropriate phases.

According to the invention, the object is also to provide an antenna structure 10 according to a second embodiment represented in FIG. 4. In this second embodiment, each of the access ports 18 and 20 of the elements 11 of a same given row (or of a same given column) of the antenna structure 10 are grouped together. Thus, all of the access ports 18, 20 of the elementary antennas 11 of the same given row (or of the same given column) are connected to a duplexer 52 in order to ensure proper isolation between the first and second emitting-receiving portions 22, 24 of the elementary antennas 11 considered. For the purposes of simplification, in FIG. 4, only the links between some of the elementary antennas 11 of the same row are represented and all of the rows are not represented.

The antenna structure 10 thus includes as many duplexers 52 as there are rows (or columns). As is the case for FIG. 4, the switches 54 inserted between the duplexer 52 and the access ports 18, 20 can make possible the easy selection of the access port 18, 20 and the operation desired for the antenna structure 10.

In addition, each elementary antenna 11 is associated with a phase control circuit. Thus, it is possible to orient the beam of the antenna structure 10 in any one single direction in a hemisphere, based on the phase control circuits associated with each of the elementary antennas 11. As per the terminology used by the specialist in the field of antennas, this is known as implementing a one dimensional scanning or unidirectional scanning. In this configuration, in order to obtain bidirectional scanning, the antenna structure 10 is coupled to a motor driven system with one axis.

In a third embodiment (the one shown in FIG. 5), all the access ports 18 and 20 of the elementary antennas 11 are grouped together. Thus, for the entire antenna structure 10, only two unique access ports are available. Each of these access ports is associated with a duplexer in order to ensure proper isolation between the emitting-receiving portions. For the purposes of simplification, in FIG. 5, only the links between some of the elementary antennas 11 of the same row are represented and all of the rows are not represented.

In this third embodiment, the orientation of the radiation pattern of the antenna structure 10 is unique and cannot be controlled. As per the terminology used by the specialist in the field of antennas, this is known as creating a fixed radiating panel.

Thus, the proposed antenna structure 10 may be used as a substitute for an electronic scanning antenna for telecommunications applications between two stations, in particular via satellite. It is to be noted that in this case, the radiation pattern of the antenna structure 10 thus produced is in conformity with the dimensional specifications stipulated for being used with certain satellites.

Such an antenna structure 10 may advantageously be used in a platform, in particular an aerial platform. In the context of such use, the compactness of the antenna structure 10 makes it possible to reduce the constraints at the level of the equipment installations on the platform.

What is claimed is:

1. A horn for elementary antennas for satellite telecommunications comprising:

a first emitting-receiving portion joined to a second emitting receiving portion, the first emitting receiving portion adapted to emit and receive an electromagnetic wave at a first frequency; and the second emitting-receiving portion adapted to emit and receive an electromagnetic wave at a second frequency, the second emitting-receiving portion being distinct and separate from the first emitting-receiving portion, a ratio between the second frequency and the first frequency being greater than 1.2; wherein the joining of the first and second emitting-receiving portions form the horn, wherein the horn has a cylindrical or cubic shaped form, wherein the first emitting-receiving portion and the second emitting-receiving portion together have a cylindrical or cubic shape; and wherein a first basis and a second basis are defined for the first emitting-receiving portion and the second emitting-receiving portion respectively, the joining of the first basis and the second basis forming a basis of the cylindrical or cubic shaped form of the horn.

2. The horn as recited in claim 1 wherein the waves at the first frequency and the second frequency are included in the Ka band of the electromagnetic spectrum.

3. The horn as recited in claim 1 wherein the ratio between the second frequency and the first frequency is greater than 1.5.

4. The horn as recited in claim 1 wherein the first emitting-receiving portion and the second emitting-receiving portion each have a basis sharing the same shape.

5. The horn as recited in claim 1 wherein the basis the first emitting-receiving portion and the basis of the second emitting-receiving portion together form a disk or a rectangle.

6. An elementary antenna comprising at least one of the horn as recited in claim 1.

7. The elementary antenna as recited in claim 6 further comprising dielectric elements.

8. The elementary antenna as recited in claim 6 further comprising a polariser arranged in a manner so as to polarise the waves that the first emitting-receiving portion and the second emitting-receiving portion are adapted to emit.

9. The elementary antenna as recited in claim 8 wherein the polariser includes two parts arranged in a manner so as to circularly polarise in a first direction the electromagnetic waves that the first emitting-receiving portion is adapted to emit and to circularly polarise the electromagnetic waves that the second emitting-receiving portion is adapted to emit in a direction opposite to the first direction.

10. An antenna structure comprising at least one of the elementary antenna as recited in claim 6.

11. An aerial platform comprising at least one of the elementary antenna as recited in claim 6.

12. An aerial platform comprising the antenna structure as recited in claim 10.

13. A method for telecommunication between two stations, the method comprising:

emitting and receiving electromagnetic waves using at least one of the elementary antenna as recited claim 6.

14. A method for telecommunication between two stations, the method comprising:

emitting and receiving electromagnetic waves using at least one of the antenna structure as recited in claim 10.

* * * * *